US006575005B1

(12) United States Patent
Hunter

(10) Patent No.: US 6,575,005 B1
(45) Date of Patent: Jun. 10, 2003

(54) LOCKED/UNLOCKED INDICATOR FOR A KEY

(76) Inventor: Theodore K. Hunter, 501 Riverside Ave., Paso Robles, CA (US) 93446

( * ) Notice: Subject to any disclaimer, the term of this patent is extended or adjusted under 35 U.S.C. 154(b) by 0 days.

(21) Appl. No.: 10/032,112

(22) Filed: Dec. 20, 2001

(51) Int. Cl.[7] ..... E05B 41/00
(52) U.S. Cl. ..... 70/432; 70/395; 70/438
(58) Field of Search ..... 70/395, 408, 432, 70/438, 441, 456 R

(56) References Cited

U.S. PATENT DOCUMENTS

| | | | | | |
|---|---|---|---|---|---|
| 729,773 | A | * | 6/1903 | Katz | 70/395 |
| 1,237,115 | A | * | 8/1917 | Stein | 70/395 |
| 1,843,335 | A | * | 2/1932 | Oberfield | 70/395 |
| 2,176,465 | A | * | 10/1939 | Merkl | 70/395 |
| 2,198,484 | A | * | 4/1940 | Merkl | 70/395 |
| 2,373,893 | A | * | 4/1945 | Hoenger | 70/395 |
| 2,418,046 | A | * | 3/1947 | Oberfield | 70/395 |
| 2,561,944 | A | * | 7/1951 | Oberfield | 70/395 |
| 3,797,291 | A | * | 3/1974 | Simorghi | 70/395 |
| 4,432,218 | A | * | 2/1984 | Hoener | 70/395 |
| 4,440,011 | A | * | 4/1984 | Klein | 70/438 |
| 4,631,943 | A | * | 12/1986 | Hoener | 70/395 |
| 5,435,160 | A | * | 7/1995 | Linsalato et al. | 70/408 |
| 5,460,022 | A | * | 10/1995 | Parsons | 70/456 R |
| 5,595,080 | A | * | 1/1997 | Whinton | 70/432 |
| 5,937,680 | A | * | 8/1999 | Parsons | 70/456 R |

* cited by examiner

*Primary Examiner*—Suzanne Dino Barrett
(74) *Attorney, Agent, or Firm*—Knobbe, Martens, Olson & Bear, LLP

(57) ABSTRACT

A locked/unlocked indicator for a key that shows whether a person has locked a door lock or any type of lock. The indicator has a base member having a window formed in the top surface that communicates with a channel formed in the bottom surface. A slide member has a thumb tab that extends upwardly through the aperture that allows the slide member to be slid back and forth between a position that indicates whether the door lock is locked or unlocked. The bottom of the slide member is a spring member that has curved lips on the front and rear end that make an audible sound when the slide member reaches both the locked and the unlocked position. The base member has adhesive on the bottom surface for attachment to the head member of a key.

12 Claims, 2 Drawing Sheets

LOCKED/UNLOCKED INDICATOR FOR A KEY

BACKGROUND OF THE INVENTION

The invention relates to a device that can be attached to one side of the head member of a key to allow a person to know if they locked their door lock or not. More specifically the device is a locked/unlocked indicator that has structure for giving an audible signal and a visual signal when the key has been turned to the locked position.

Often people unconsciously insert a key into a door lock and turn the key to the locking position and remove the key from the lock. Later the person cannot remember if they locked the door lock or not. For piece of mind a person will return to the door to check if they had locked the door lock.

It is an object of the invention to provide a novel locked/unlocked indicator that can be easily attached to one of the sides of the head member of the key.

It is also an object of the invention to provide a novel locked/unlocked indicator that provides a visual signal that the door was locked by the position of the slide member.

It is another object of the invention to provide a novel locked/unlocked indicator that gives off an audible signal when the door has been locked.

It is a fisher object of the invention to provide a novel locked/unlocked indicator that is economical to manufacture and market.

SUMMARY OF THE INVENTION

The novel locked/unlocked indicator has a peel-away cover sheet on its bottom surface which when removed exposes a layer of adhesive that allows the indicator to be attached to one side of the head member of a key. If the door lock is locked by rotating the key to the right, the indicator is placed on the left face of the head member if the person holds the key in his right hand. The indicator would be placed on the right face of the head member, if the person holds the key in his left hand. If the lock is locked by rotating the key to the left, the orientation or placement of the indicator would always place it on the side of the key that would have the person's thumb on that side. The thumb is larger than the index finger and the thumb can more easily move the thumb tab in a more natural rotational movement. The indicator has a thumb tab extending outwardly from its front surface that will automatically come in contact with the persons thumb as they grip the key prior to turning it in order to lock the door lock. A person's natural rotation motion of the key with their thumb on the indicator will cause the thumb tab of the slide member to travel upwardly to the upper most position in the window on the front surface of the base member of the indicator. The top surface of the spring of the slide member has a first color or no color on one side of the thumb tab and a different color on the other side of the thumb tab. When the slide member is in its lower position a first color is viewable through the window in the base member and this indicates that the key is not locked. As the slide member is raised to its upper position, the different color is visible and this indicates that the key has been locked. In this manner a person need only look at the key at any time after leaving the door to determine if they had locked the door lock. Also the slide member makes an audible sound when it reaches its upper position in the window and also when it is returned to its lower position in the window.

DESCRIPTION OF THE PREFERRED EMBODIMENT

Figure 1:
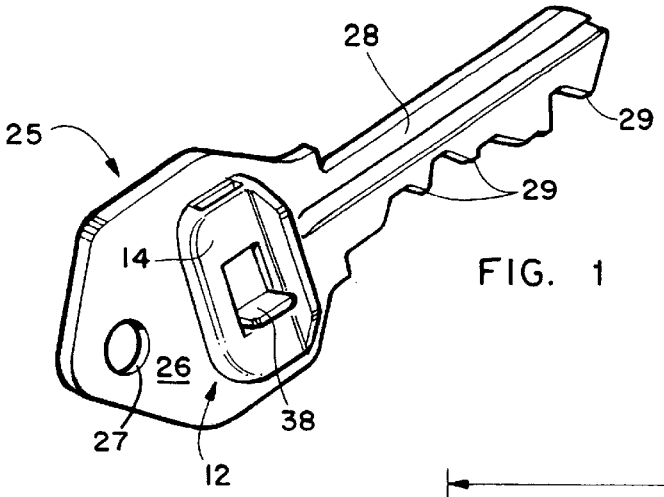
FIG. 1 is an inverted front perspective view of the locked/unlocked indicator mounted on a key.
Figure 2:
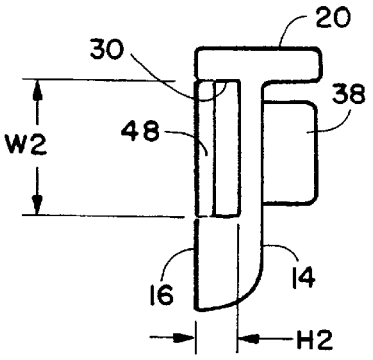
FIG. 2 is a side elevation view of the locked/unlocked indicator.
Figure 3:
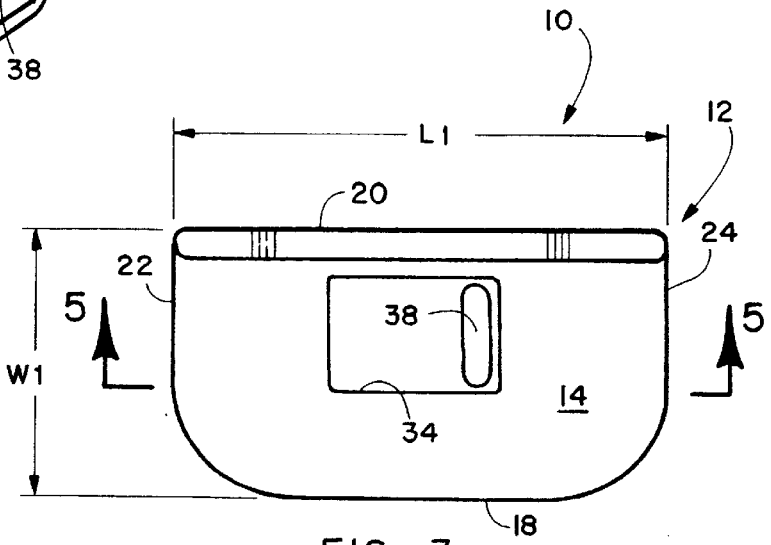
FIG. 3 is a top plan view of the locked/unlocked indicator.
Figure 4:
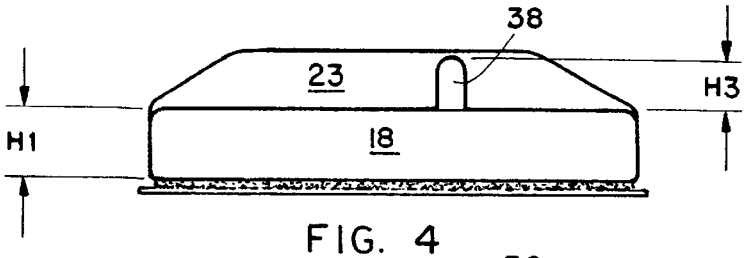
FIG. 4 is a front elevation view of the locked/unlocked indicator.

The novel locked/unlocked indicator for a key will now be described by referring to FIGS. 1–5 of the drawings. The locked/unlocked indicator is generally designated numeral 10.

Indicator 10 has a base member 12 that would be made of a hard plastic material. Base member 12 has a top surface 14, a bottom surface 16, a front wall 18, a rear wall 20, a left side wall 22 and a right side wall 24. A ridge 23 extends upwardly from rear wall 20. Base member 12 has a length L1 in the range of 0.375–1.0 inch. It has a width W1 in the range of 0.250–0.75 inch. It also has a height H1 in the range of 0.020–.375 inch. Key 25 has a head member 26, an aperture 27, a shank member 28 and teeth 29.

A channel 30 is formed in the bottom surface of base member 12. It extends from left side wall 22 to right side wall 24. Channel 30 has a width W2. A window 34 is formed in top surface 14 of base member 12. It extends downwardly until it communicates with channel 30. Slide member 36 has a thumb tab 38 that extends upwardly from the top surface of spring member 40. Spring member 40 is captured in channel 30 with the thumb tab 38 extending upwardly through window 34. Spring member 40 has a length L2. A downwardly curved lip 42 is formed on the front end of spring member 40 and a downwardly curved lip 44 is formed on the rear end of spring member 40. A cover panel 48 is inserted into channel 30 under spring member 40 to capture it therein. A layer of adhesive 50 is formed on the bottom surface of base member 12 and cover panel 48 and a peel away cover sheet 52 covers adhesive layer 50.

Figure 6:
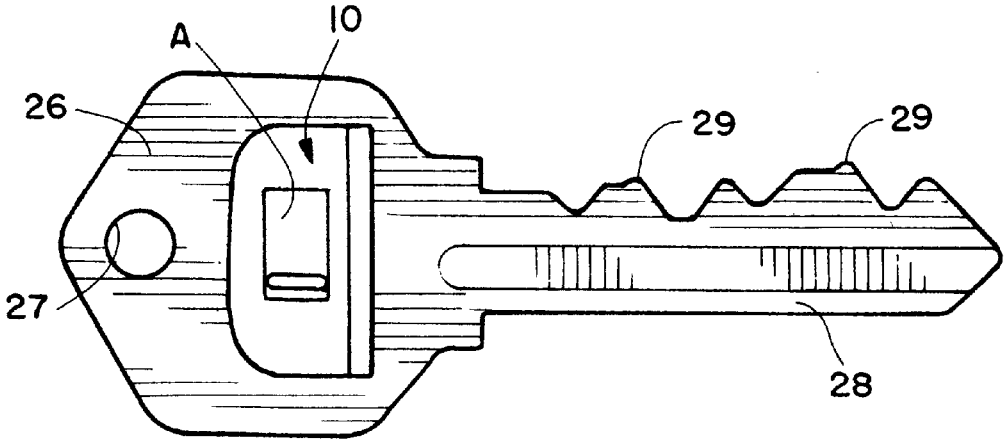
FIG. 6 is an enlarged side elevation view of the key showing the locked/unlocked indicator visually showing it to be in the unlocked position.
Figure 7:
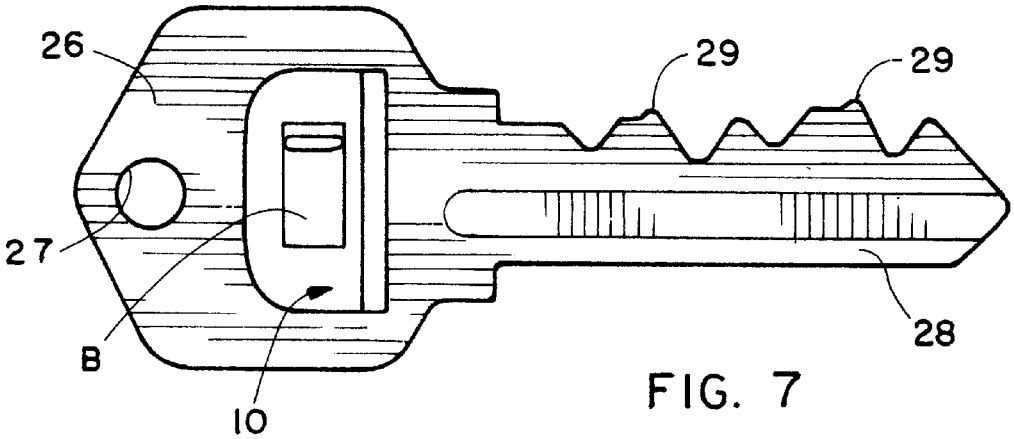
FIG. 7 is an enlarged side elevation view of the key showing the locked/unlocked indicator visually showing it to be in the locked position.

The top surface of spring member 40 indicates a first color on the left side of the thumb tab 38 and a second color on the top surface of spring member 40 on the right side of thumb tab member 38. FIG. 6 shows color A on the portion of the surface on spring member 40 that is visible through window 34. The color A indicates that the key has not locked the door. In FIG. 7, the color B on the portion of the surface on the spring member 40 is visible through window 34 and it indicates that the door lock has been locked. This allows a person to look at the key indicator after they have walked away from the door or at a later time and view the indicator to see which color is visible in window 34.

Figure 5:
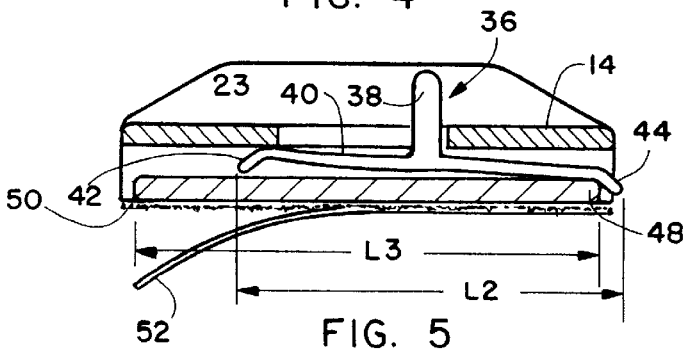
FIG. 5 is a vertical cross section taken along lines 5—5 of FIG. 3.

Referring to FIG. 5, spring member 40 can be made of either plastic or metal material. Cover panel 48 has a length L3 and L3 is slightly less than L1. As slide member 36 is moved from its rearward most position to its forward most position, front lip 42 of spring member 40 will snap over the front edge of cover panel 48 and produce an audible sound in the form of a click. This audible sound allows a person to know they have locked the door lock. Likewise as the slide member 36 is slid to its rear most position, the rear lip 44 is snapped over the rear end of cover panel 48 causing an audible click sound. This indicates that the door lock has been unlocked.

Figure 8:
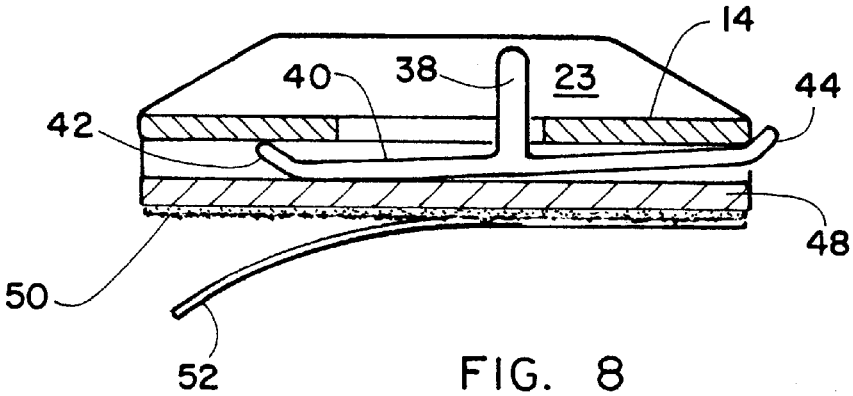
FIG. 8 is an enlarged vertical cross sectional view of a first alternative embodiment.

An alternative embodiment is illustrated in FIG. 8. This embodiment shows that the front lip 42 has been curved upwardly and the rear lip 44 of spring member 30 has been turned upwardly. Spring member 40 will make the click sound when the respective front and rear lip members travel over the front and rear edges of channel 30.

What is claimed:

1. A locked/unlocked indicator for a key that shows whether a person has locked a door or not comprising:

a base member having a top surface, a bottom surface, a front wall, a rear wall, a left side wall, a right side wall, a length (L1), a width (W1) and a thickness (H1);

a channel is formed in said bottom surface of said base member and said channel extends from said left side wall to said right side wall; said channel has a height (H2) and a width (W2); a window is formed in said top surface of said base member and said window extends downwardly and connects with said channel;

an elongated spring member having a top surface, a bottom surface, a length (L2), a left end, a right end and a thumb tab that extends upwardly from said top surface of said spring member at a point intermediate said length (L2); said spring member is slidably received in said channel and said thumb tab extends upwardly through said window a predetermined height (H3) above said top surface of said base member;

an elongated cover panel having a width (W2) and a length (L3) is removably positioned under said spring member to close said channel; and visual signal means on said top surface of said spring member to indicate whether a person has locked a door or not.

2. A locked/unlocked indicator for a key as recited in claim 1 wherein said visual signal means comprises a first color on said top surface of said spring member to the left of said thumb tab and a different color on said top surface of said spring member to the right of said thumb tab.

3. A locked/unlocked indicator for a key as recited in claim 1 further comprising a layer of adhesive on said bottom surface of said base member and said cover panel.

4. A locked/unlocked indicator for a key as recited in claim 3 wherein said base member is adhered to the head member of a key.

5. A locked/unlocked indicator for a key as recited in claim 3 further comprising a cover sheet on said layer of adhesive.

6. A locked/unlocked indicator for a key as recited in claim 1 wherein said spring member is made of plastic material.

7. A locked/unlocked indicator for a key as recited in claim 1 wherein said spring member is made of metal.

8. A locked/unlocked indicator for a key as recited in claim 1 wherein said base member is made of plastic material.

9. A locked/unlocked indicator for a key as recited in claim 1 further comprising a ridge extending upwardly from said top surface of said base member along said rear wall.

10. A locked/unlocked indicator for a key as recited in claim 1 farther comprising audible signal means for indicating if a door has been locked or unlocked.

11. A locked/unlocked indicator for a key that shows whether a person has locked a door or not comprising:

a base member having a top surface, a bottom surface, a front wall, a rear wall, a left side wall, a right side wall, a length (L1), a width (W1) and a thickness (H1);

a channel is formed in said bottom surface of said base member and said channel extends from said left side wall to said right side wall; said channel has a height (H2) and a width (W2); a window is formed in said top surface of said base member and said window extends downwardly and connects with said channel;

an elongated spring member having a top surface, a bottom surface, a length (L2), a left end, a right end and a thumb tab that extends upwardly from said top surface at a point intermediate said length (L2); said spring member is slidably received in said channel and said thumb tab extends upwardly through said window a predetermined height (H3) above said top surface of said base member;

an elongated cover panel having a width (W2) and a length (L3) is removably positioned under said spring member to close said channel; and audible signal means for indicating if a door has been locked or unlocked.

12. A reminding key, comprising:

A key having a head with two sides;

An indicator which can move to show whether a person has locked a door; and

An adhesive attaching said indicator to one of said two sides of said head of said key; and wherein said adhesive provides the sole attachment for said indicator to said key.

* * * * *

UNITED STATES PATENT AND TRADEMARK OFFICE

CERTIFICATE OF CORRECTION

PATENT NO. : 6,575,005 B1
DATED : June 10, 2003
INVENTOR(S) : Theodore K. Hunter It is certified that error appears in the above-identified patent and that said Letters Patent is hereby corrected as shown below:

Column 4,
Lines 43-51, claim 12 should read:

12. A reminding key, comprising:
    A key having a head with two sides;
    An indicator which can move to show whether a person has locked a door; and
    An adhesive attaching said indicator to one of said two sides of said head of said key; and wherein said adhesive provides the sole attachment for said indicator to said key.

Signed and Sealed this

Twenty-eighth Day of October, 2003

JAMES E. ROGAN
*Director of the United States Patent and Trademark Office*